US005816056A

United States Patent [19]

Ruffa

[11] Patent Number: 5,816,056

[45] Date of Patent: Oct. 6, 1998

[54] COOLING WITH THE USE OF A CAVITATING FLUID FLOW

[75] Inventor: Anthony A. Ruffa, Hope Valley, R.I.

[73] Assignee: The United States of America as represented by the Secretary of the Navy, Washington, D.C.

[21] Appl. No.: 812,099

[22] Filed: Feb. 26, 1997

[51] Int. Cl.[6] ..... F25B 23/00

[52] U.S. Cl. ..... 62/119; 165/915

[58] Field of Search ..... 62/119, 118, DIG. 2; 165/915, 104.29, DIG. 516, DIG. 515, DIG. 517

[56] References Cited

U.S. PATENT DOCUMENTS

| | | | |
|---|---|---|---|
| 2,153,644 | 4/1939 | Schierenbeck | 165/915 X |
| 5,666,814 | 9/1997 | Yamamoto | 62/119 X |

FOREIGN PATENT DOCUMENTS

| | | | |
|---|---|---|---|
| 5-18612 | 1/1993 | Japan | 165/915 |
| 964417 | 10/1982 | U.S.S.R. | 165/915 |
| 1142718 | 2/1985 | U.S.S.R. | 165/915 |
| 1379586 | 3/1988 | U.S.S.R. | 165/915 |

*Primary Examiner*—Harry B. Tanner
*Attorney, Agent, or Firm*—Michael J. McGowan; Robert W. Gauthier; Prithvi C. Lall

[57] ABSTRACT

A method and system are provided for cooling a medium. A fluid is moved through the medium and bubbles are induced in the fluid as it moves through the medium. The bubble formation is induced by applying an acoustic field to the fluid as it moves through the medium. A heat sink can be thermally coupled to the fluid downstream of the medium so that heat rejected during bubble contraction and collapse is passed to the heat sink. The pressure of the fluid, i.e. the velocity of the fluid, can also controlled so that the bubbles contract and collapse in the region of the heat sink.

17 Claims, 2 Drawing Sheets

COOLING WITH THE USE OF A CAVITATING FLUID FLOW

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The present invention relates generally to methods and systems for cooling, and more particularly to a method and system for cooling a medium using a cavitating fluid flow.

(2) Description of the Prior Art

The cooling of a medium is frequently a consideration in many system designs. However, more often than not, the cooling system is not adequately considered until the system's primary design objectives are achieved. Unfortunately, the cooling system must then be designed or selected to fit within the overall system architecture. This has led to the development of a variety of cooling system designs over the years. For example, even standing acoustic waves have been used to cool a medium. In U.S. Pat. No. 5,165,243, a resonator chamber cooperates with first and second thermodynamic elements to support a standing acoustic wave used to activate such cooling. In U.S. Pat. No. 5,357,757, a compressor includes a chamber containing a gaseous refrigerant that is compressed by means of a constant-wavelength, standing acoustic wave. However, space or access limitations around a medium may prevent conventional cooling systems (e.g., fans, insulation, heat sinks or fins), or systems using acoustically cooled chambers as described above, from being arranged in an effective manner around the medium thereby creating a need for a specially designed cooling system. Consequently, the more cooling system designs or approaches there are in the art, the greater the chance that a particular system architecture can utilize existing technology as opposed to developing new technology.

SUMMARY OF THE INVENTION

Accordingly, it is an object of the present invention to provide a method and system of cooling a medium.

Another object of the present invention is to provide a method and system of cooling a medium when there is limited access to the medium.

Other objects and advantages of the present invention will become more obvious hereinafter in the specification and drawings.

In accordance with the present invention, a method and system are provided for cooling a medium. A fluid is moved through the medium and bubbles are induced in the fluid as it moves through the medium. The latent heat of vaporization required for bubble formation is absorbed from the medium. In most applications, a conduit is provided through the medium for transporting the fluid. The bubble formation is induced by applying an acoustic field to the fluid as it moves through the medium. A heat sink can be thermally coupled to the fluid downstream of the medium so that heat rejected during bubble contraction and collapse is passed to the heat sink. The pressure of the fluid, i.e. the velocity of the fluid, can also be controlled so that the bubbles contract and collapse in the region of the heat sink.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DESCRIPTION OF THE PREFERRED EMBODIMENT(S)

Figure 1:
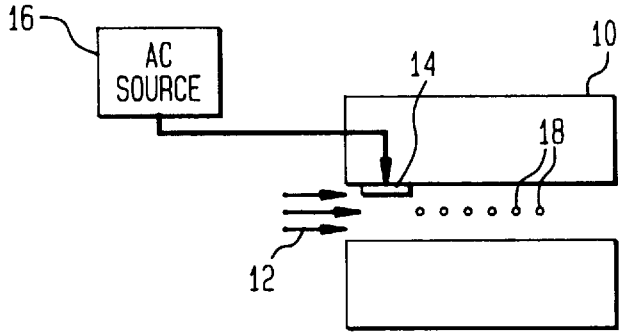
FIG. 1 is a schematic view of the basic system elements used to carry out cooling in accordance with the present invention.

Referring now to the drawings, and more particularly to FIG. 1, the basics of the present invention will be explained. A medium 10 is shown with a fluid flow passing therethrough as represented by arrows 12. In this embodiment, it is assumed medium 10 is a solid medium and that the fluid in fluid flow 12 is non-corrosive with respect to medium 10. An acoustic transducer 14 is disposed so as to transfer acoustic energy to fluid flow 12 and is coupled to an AC source 16 for excitation thereof. For purpose of illustration, only one transducer 14 is shown. However, it is to be understood that a plurality of such acoustic transducers can be disposed in fluid flow 12, each of which could be excited by the same AC source 16 or by different AC sources.

Figure 2:
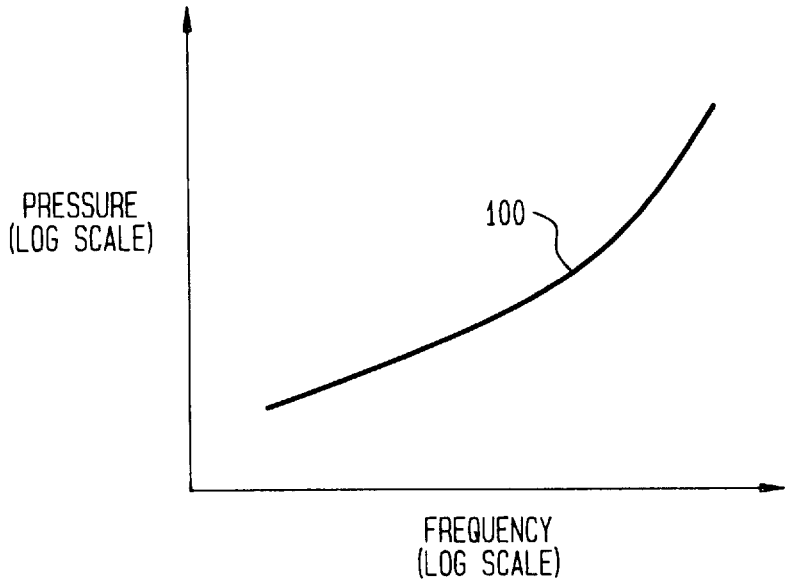
FIG. 2 is a logarithmic plot depicting, in general, the cavitation threshold curve as a function of frequency.

The method of cooling in the present invention is as follows. As fluid flow 12 passes through medium 10, AC source 16 excites acoustic transducer 14 to create a low-frequency, high-amplitude acoustic field in fluid flow 12. In general, the amplitude of the acoustic field must be sufficient to induce cavitation in fluid flow 12. In FIG. 1, such cavitation is represented by bubbles 18. Since cavitation threshold pressure increases as a function of frequency as shown generally by curve 100 in FIG. 2, once the specifics of curve 100 are known for fluid flow 12 through medium 10, transducer 14 is driven to maintain operation above curve 100.

The amount of energy required to induce cavitation bubbles 18 is dependent on the pressure (static pressure plus pressure drop due to fluid velocity) of the fluid, the particular fluid used, and the cavitation threshold which is a function of the frequency. The formation of bubbles 18 requires a latent heat of vaporization which is absorbed from medium 10 to thereby cool medium 10. In order for heat to be absorbed from medium 10, the temperature of fluid flow 12 is no more than and typically less than that of medium 10.

Figure 3:
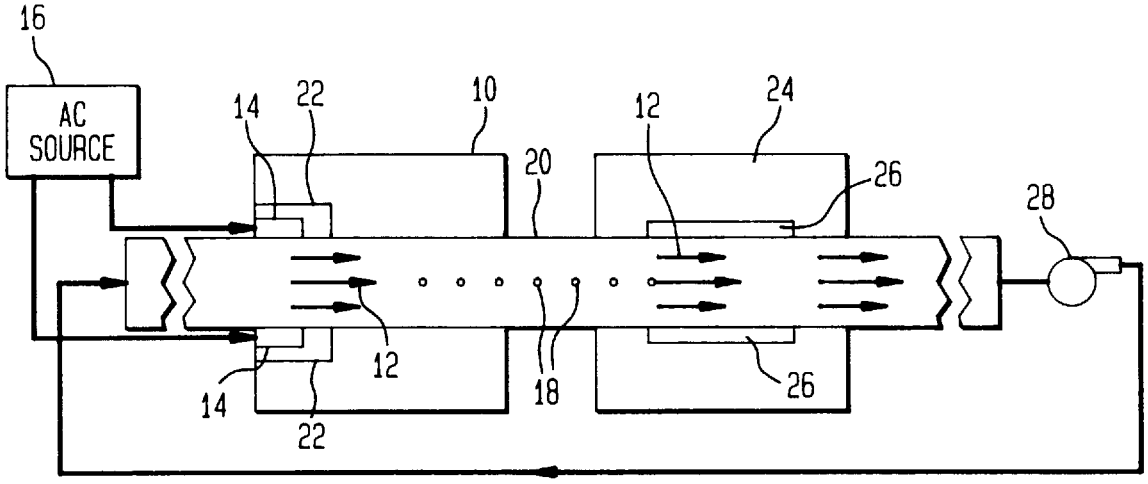
FIG. 3 is a schematic view of a closed-loop embodiment of the present invention.

The basic cooling approach of the present invention can be utilized in a variety of embodiments. Two closed-loop system embodiments will now be explained with the aid of FIGS. 3 and 4. In FIG. 3, a conduit 20 is passed through medium 10. Accordingly, medium 10 can be a gas, liquid or solid. Conduit 20 is made from a material that is non-corrosive with respect to the fluid of fluid flow 12. Conduit 20 can be made of a material that readily transfers heat (e.g., stainless steel, aluminum, copper, etc.). Such heat transfer capability can be enhanced by providing one or more heat transfer fins 22 about conduit 20 to thermally couple medium 10 to fluid flow 12. A plurality of acoustic transducers 14 are preferably disposed on the outside of conduit 20 and are coupled to AC source 16 for receiving excitation power. Transducers 14 are generally placed at the point where fluid flow 12 enters medium 10. Additionally, a heat sink 24 is thermally coupled to fluid flow 12 downstream of medium 10. Thermal coupling can be via conduit 20 and/or heat transfer fins 26. Heat sink 24 is thermally isolated from medium 10 as indicated in FIG. 3 by the space therebetween. Heat sink 24 and fins 26 are disposed along the length of conduit 20 where the contraction and collapse of bubbles 18 are expected.

In operation of the embodiment of FIG. 3, cavitation bubbles 18 are induced in fluid flow 12 by the excitation of transducers 14 as described above. The creation of bubbles 18 removes heat from medium 10. Then, as bubbles 18 contract and collapse in the region of heat sink 24 and fins 26, heat is rejected to heat sink 24 thereby cooling fluid flow 12 around such bubble collapse. In this way, fluid flow 12 can be recycled by pump 28 through medium 10 to thereby create a closed-loop system.

Since size limitations might not permit the use of a large heat sink 24, it may be desirable to control the location of the contraction and collapse of bubbles 18 through the control of the pressure in fluid flow 12. The pressure of fluid flow 12 is proportional to the square of the velocity of the flow in accordance with the Bernoulli equation. Thus, the embodiment of FIG. 4 includes means for controlling the velocity of fluid flow 12 so that the collapse of bubbles 18 occurs in a specified region of conduit 20 downstream of medium 10. It is at this specified region where heat sink 24 and/or fins 26 are positioned.

Figure 4:
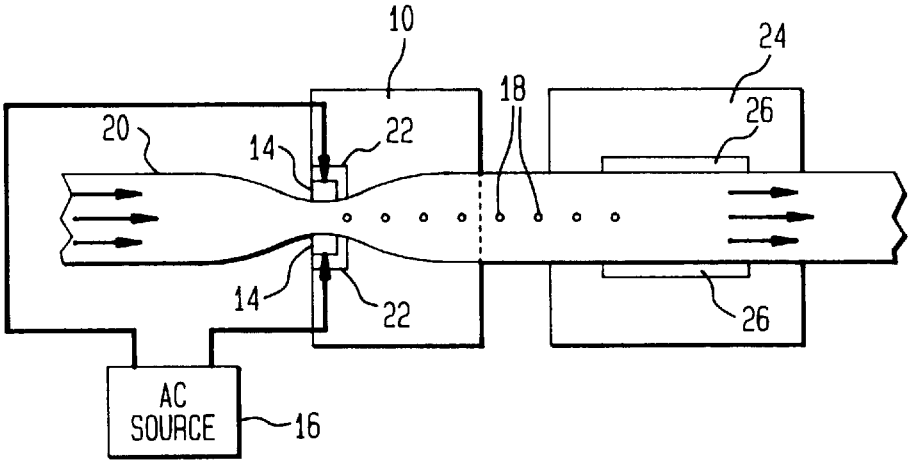
FIG. 4 is a schematic view of another closed-loop embodiment of the present invention.

In FIG. 4, velocity control is achieved by reducing the diameter of conduit 20 at medium 10, e.g., the point where conduit 20 enters medium 10. This increases the velocity of fluid flow 12 through medium 10. Acoustic transducers 14 are placed at the reduced diameter portion of conduit 20. In addition to increasing the velocity, the reduction in diameter of conduit 20 means that there is less fluid volume in the region of bubble formation. Thus, as each bubble 18 is formed, heat is more readily transferred from medium 10 to fluid flow 12. To increase the life of cavitation bubbles within fluid flow 12, the diameter of conduit 20 is increased downstream of where cavitation bubbles 18 are formed. The increased diameter results in a reduced flow velocity and pressure. The reduced pressure in this section of conduit 20 prolongs the collapse of bubbles 18 to a point along conduit 20 where heat sink 24 and/or fins 26 may be more conveniently located.

Note that the region of conduit 20 passing through heat sink 24, i.e., the region where bubbles 18 will contract and collapse, may require interior walls that are more resistant to pitting damage caused by collapsing vapor bubbles 18. It is likely, however, that bubbles 18 will remain in the center of conduit 20 where the flow velocity is greatest due to the Bernoulli effect.

The advantages of the present invention are numerous. Active cooling is achieved in a simple fashion and can be controlled to occur in a very compact region. Since cooling occurs from within a medium, space limitations surrounding the medium are not of concern. Further, the velocity of the fluid flow can be controlled so that heat rejection, i.e., bubble collapse, occurs at a downstream region so that the fluid flow can be recycled for use in a closed-loop system.

Although the present invention has been described relative to some specific embodiments, it is not so limited. The fluid used for fluid flow 12 could be chosen based on the material used for conduit 20. For example, if conduit 20 were stainless steel, the fluid could simply be water. If conduit 20 were another material, the fluid could be any one of several hydraulic fluids. Thus, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A method of reducing a temperature of a medium, comprising the steps of:

moving a fluid through said medium, the fluid having a temperature no greater than the temperature of the medium; and inducing the formation of bubbles in said fluid moving through said medium by applying an acoustic field to said fluid moving through said medium.

2. A method according to claim 1 wherein said step of inducing occurs as said fluid enters said medium.

3. A method according to claim 1 further comprising the step of thermally coupling a heat sink to said fluid, said heat sink being thermally isolated from said medium and being located downstream of said medium with respect to a direction of movement of said fluid.

4. A method according to claim 3 further comprising the step of controlling the pressure of said fluid such that said bubbles contract and collapse in the region of said heat sink.

5. A method according to claim 4 wherein said step of controlling the pressure is accomplished by controlling the velocity of said fluid.

6. A method of reducing a temperature of a medium, comprising the steps of:

providing a conduit that passes through said medium, said conduit being capable of transferring heat through the walls thereof;

moving a fluid through said conduit, the fluid having a temperature no greater than the temperature of the medium; and inducing cavitation bubbles in said fluid moving through said medium within said conduit by applying an acoustic field to said fluid moving through said medium within said conduit.

7. A method according to claim 6 wherein said step of inducing occurs as said fluid moving through said conduit passes into said medium.

8. A method according to claim 6 further comprising the step of thermally coupling a heat sink to said conduit, said heat sink being thermally isolated from said medium and being located downstream of said medium with respect to a direction of movement of said fluid.

9. A method according to claim 8 further comprising the step of controlling the pressure of said fluid moving through said conduit such that said cavitation bubbles contract and collapse in the region of said heat sink.

10. A method according to claim 9 wherein said step of controlling the pressure is accomplished by controlling the velocity of said fluid.

11. An apparatus for reducing a temperature of a medium, comprising:

a conduit passing through said medium, said conduit being capable of transferring heat through the walls thereof;

a fluid moving through said conduit, the fluid having a temperature no greater than the temperature of the medium;

at least one acoustic transducer acoustically coupled to said fluid moving through said medium within said conduit; and an excitation source coupled to said at least one acoustic transducer for exciting said at least one acoustic transducer to induce cavitation bubbles in said fluid moving through said medium within said conduit.

12. An apparatus as in claim 11 wherein said at least one acoustic transducer is located in said conduit where said fluid enters said medium.

13. An apparatus as in claim 11 further comprising a heat sink thermally coupled to said conduit, said heat sink being thermally isolated from said medium and being located downstream of said medium with respect to a direction of movement of said fluid.

14. An apparatus as in claim 13 further comprising:

a first plurality of heat transfer fins mounted on said conduit for thermally coupling said medium to said fluid moving through said medium within said conduit; and a second plurality of heat transfer fins mounted on said conduit for thermally coupling said heat sink to said fluid moving past said heat sink within said conduit.

15. An apparatus as in claim 11 wherein said conduit is shaped to cause an increase in velocity of said fluid moving through said medium within said conduit.

16. An apparatus as in claim 11 wherein said conduit is shaped to cause a decrease in velocity of said fluid moving through said medium within said conduit.

17. An apparatus as in claim 11 wherein said at least one acoustic transducer comprises a plurality of acoustic transducers mounted about said conduit.

* * * * *